US006866560B1

(12) United States Patent
Follstaedt et al.

(10) Patent No.: US 6,866,560 B1
(45) Date of Patent: Mar. 15, 2005

(54) METHOD FOR THINNING SPECIMEN

(75) Inventors: David M. Follstaedt, Albuquerque, NM (US); Michael P. Moran, Rio Rancho, NM (US)

(73) Assignee: Sandia Corporation, Albuquerque, NM (US)

( * ) Notice: Subject to any disclaimer, the term of this patent is extended or adjusted under 35 U.S.C. 154(b) by 105 days.

(21) Appl. No.: 10/339,832

(22) Filed: Jan. 9, 2003

(51) Int. Cl.[7] ..... B24B 1/00

(52) U.S. Cl. ..... 451/28; 451/6; 451/41; 451/287; 438/692

(58) Field of Search ..... 451/6, 41, 28, 451/287–290, 530, 527, 534, 529, 921, 550; 438/692, 693

(56) References Cited

U.S. PATENT DOCUMENTS 4,977,710 A * 12/1990 Une ..... 51/309
5,618,227 A 4/1997 Tsutsumi et al.
5,698,474 A 12/1997 Hurley
5,797,789 A 8/1998 Tanaka et al.
6,093,092 A * 7/2000 Ramanath et al. ..... 451/541
6,248,000 B1 * 6/2001 Aiyer ..... 451/41
6,273,806 B1 * 8/2001 Bennett et al. ..... 451/527
6,325,702 B2 * 12/2001 Robinson ..... 451/41
6,332,830 B1 * 12/2001 Okamura et al. ..... 451/36
6,402,594 B1 6/2002 Kobayashi et al.
6,419,574 B1 7/2002 Takahashi et al.
6,443,817 B1 9/2002 McCarter et al.
6,458,017 B1 * 10/2002 Li et al. ..... 451/28
6,468,136 B1 * 10/2002 Lum et al. ..... 451/41
6,485,533 B1 * 11/2002 Ishizaki et al. ..... 51/307
6,561,883 B1 * 5/2003 Kondo et al. ..... 451/63
6,634,929 B1 * 10/2003 Visser ..... 451/41

* cited by examiner

*Primary Examiner*—Lee D. Wilson
*Assistant Examiner*—Anthony Ojini
(74) *Attorney, Agent, or Firm*—Elmer A. Klavetter

(57) ABSTRACT

A method for thinning (such as in grinding and polishing) a material surface using an instrument means for moving an article with a discontinuous surface with an abrasive material dispersed between the material surface and the discontinuous surface where the discontinuous surface of the moving article provides an efficient means for maintaining contact of the abrasive with the material surface. When used to dimple specimens for microscopy analysis, a wheel with a surface that has been modified to produce a uniform or random discontinuous surface significantly improves the speed of the dimpling process without loss of quality of finish.

15 Claims, 3 Drawing Sheets

30

METHOD FOR THINNING SPECIMEN

This invention was made with Government support under Contract No. DEAC-04-94AL85000 awarded by the Department of Energy. The Government has certain rights in the invention.

BACKGROUND OF THE INVENTION

The invention describes a method to thin the surface of a material and, more particularly, to a method to thin the surface of a material utilizing an article with a discontinuous, moveable surface.

Thinning of surfaces to thicknesses of several microns or several tens or hundreds of microns is often required for purposes including microscopy analysis and manufacturing of parts made from materials including silicon and glass. Various techniques can be used to thin surfaces, both mechanical and non-mechanical. For example, in integrated packages, such as plastic encapsulated devices, thinning can be achieved by a planar lapping technique using diamond slurries. Etching compounds and reagents can be used on some materials to effect thinning. Ion milling can be used by applying a focused ion beam to erode semiconductor materials. Mechanical means such as lapping and dimpling can be utilized for a variety of materials.

Dimpling is a technique that was developed for the preparation of materials for microscopy, particularly transmission electron microscopy (TEM), analysis. For many materials the preparation sequence often involves disc cutting, planarizing, dimpling, and ion-milling. Dimpling produces a disc, commonly 2.3 or 3.0 mm in diameter, with a thinned central area and a thicker outer rim, thus forming a bowl-shaped cut known as a dimple. This geometry is achieved by the action of a rotating wheel carrying an abrasive slurry to erode a specimen simultaneously rotating about a perpendicular axis.

The technique is time-consuming as the low RPM tool speed can take hours to days to grind and polish surfaces made from materials including ceramics, semiconductors, metal oxides, and soft and hard metals. Such mechanical thinning can also produce stress in the material such that some materials, particularly hard and brittle materials, can fracture before the desired material thickness is achieved.

DESCRIPTION OF SPECIFIC EMBODIMENTS

Figure 1:
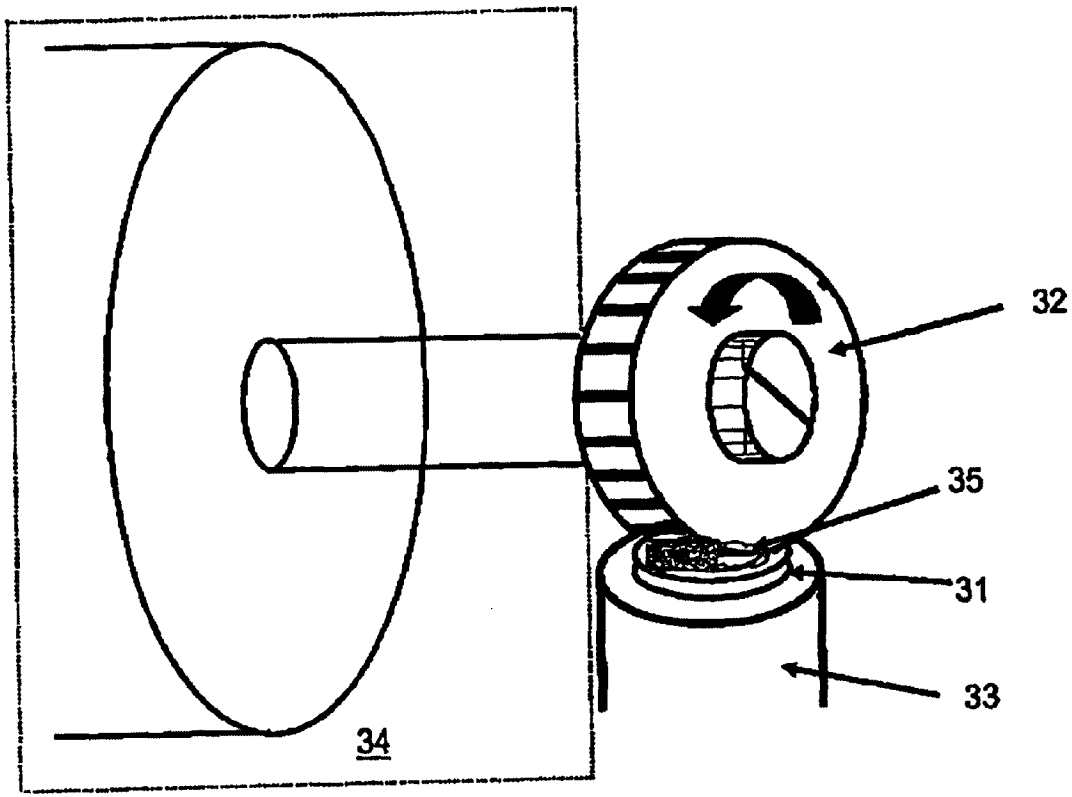
FIG. 1 shows an illustration of a thinning member article, specimen, instrument means, abrasive material and mounting table used in the method of the present invention.

The present invention comprises a method for thinning (such as in grinding and polishing) a material (specimen) with a moveable article having a discontinuous surface that is moved by an instrument means relative to the surface of the material to be thinned and utilizing an abrasive material dispersed between the surface of the specimen and the moveable article. According to the method of the present invention, the thinning of the surface of the specimen can be accomplished more efficiently with lower stresses imposed on the specimen surface than by utilizing a standard method with a moveable article with a smooth surface.

A commonly used method for preparing thin specimens of materials to be examined, such as by a microscopy method, is to thin (that is, remove material from) the specimen mechanically and then finish the specimen by ion milling. Typically, the specimen to be prepared is a disk that is first polished to a planar geometry, having two flat, parallel sides, followed by dimpling (polishing a hemispherical crater in one or both sides of the specimen). This produces a very thin central area in the specimen, while leaving a stronger, thicker edge for handling. This thin area is necessary for analysis by the microscopy technique. The dimpling is generally performed with a smooth, continuous surface, such as the surface on a wheel, rotating above the specimen. The specimen is mounted on a table that can rotate around an axis through the center of the area to be dimpled. The continuous surface and the table can be simultaneously rotated to produce a hemispherical dimple in the specimen surface. The polishing surface is lowered onto the specimen where an adjustable weight on the apparatus controls the load (or contact pressure) of the rotating surface on the specimen. An abrasive paste or slurry material, often thinned with a light cutting fluid, is spread on the rotating surface, either manually or by means for supplying the abrasive material. The intended mode of thinning is for the abrasive material to be carried around by the rotating (dimpling) surface (such as a wheel) and into contact with the specimen while under pressure from the load on the rotating surface, thereby mechanically abrading the specimen and removing material from the specimen to form the dimple. By adjusting rotation speeds, load on the rotating surface, and the nature of the abrasive, a hemispherical dimple with a smooth, polished surface can be produced.

Such a thinning process can be used efficiently with relatively soft materials, such as Si, but proceeds slowly with harder materials, such as semiconductor materials, ceramics and metal oxides, such as sapphire. Increasing the rate of thinning by increasing the load on the rotatable surface or by using coarser abrasive materials can result in fractures in the material to be thinned, alterations in the state of the material, or non-smooth surfaces.

In the present invention, the thinning process is significantly improved with enhanced operational flexibility by modification of the smooth, continuous surface used to thin a material. The modification of the continuous surface results in a surface that is discontinuous, thereby providing grooves, slots, voids, depressions, or other types of topological variations in the surface that function to better retain the abrasive material at the contact between the discontinuous surface and the material to be thinned. The use of this discontinuous surface results in increased removal rate of material from the specimen, more controlled removal of material, finer surface finishes, thinner specimens, and decreased induced stress in the specimen, thereby reducing the fracturing rate of some materials.

The discontinuous surface utilized in the method of the present invention can comprise various geometries but will commonly be of a cylindrical (such as a wheel), spherical or planar (polyhedral) geometry. Polishing wheels are typically smooth cylindrical and rotatable surfaces made of hard or soft metals. Planar surfaces are used to thin and polish a variety of materials, such as semiconductor materials, with the movement of these surfaces predominantly two-dimensional, approximately parallel to the surface of the material to be thinned. The results of experiments described herein demonstrate that the discontinuous surfaces of the present invention can be made of materials including, but not limited to, hard and metals, such as stainless steel, bronze, brass, and copper, ceramic materials, composite materials, such as fiberglass or phenolic materials, natural materials such as wood, paper or sandpaper, or materials with natural or synthetic fibers, such as felt, or even soft materials such as plastics or polymeric materials. The discontinuities on the surface can comprise any irregularity in the surface where a portion of the surface has been removed such as to make depressions, voids, or other discontinuities in the surface and can be either random or patterned. Although even a small fraction of discontinuities improves the performance of the surface, for best results, the discontinuities should be spaced evenly around the wheel; with approximately 10 or more discontinuities being needed to optimize performance (representing greater than approximately 5% of the surface area of the thinning article).

The optimum ratio of voids to surface contact area in patterning the surface of the present invention is dependent upon the character of the voids, as related to their exact placement and slurry transport ability, as well as the nature of the material comprising the wheel. In the case of a porous bronze wheel, with its random arrangement of discreet voids and contact surfaces, for example, one must take into account the nature and arrangement of the regions of contact as well as the nature and arrangement of the voids in explaining the efficiency of this particular type of discontinuous surface.

The final thinned, dimpled surfaces of the specimen materials should be smooth to produce the best specimens for microscopy. When any metal burrs are removed from the discontinuous surfaces (such as patterned wheels), and they are "dressed" by producing an initial deep dimple, optical examinations of their subsequent dimples show that the quality of finish is as good as or better than that obtained with a smooth, continuous surface. Thus there is no loss, and often an improvement, of specimen quality commensurate with the improved performance of the discontinuous surfaces of the present invention. Moreover, in tests using no abrasive slurry the material removal rate of the discontinuous surfaces is lower than that of the smooth surfaces. This also indicates that with the discontinuous surface the abrasive grit is being more effectively transported to the contact zone to remove material and to produce a finish characteristic of the abrasive; removal is not occurring by scoring the material with the edges of the patterns cut into the wheel surfaces.

The method of the present invention for thinning (such as in grinding and polishing) a material (specimen) comprises moving a thinning member having a discontinuous surface 32, as depicted in FIG. 1 illustrating an apparatus 30 to implement the method of the present invention, by an instrument means 34 relative to the surface of the material (specimen) 31 to be thinned, said specimen mounted on a platform 33 so as to have an exposed surface and dispersing an abrasive material 35 dispersed between the surface of the specimen and the moveable thinning member. The specimen to be thinned is mounted onto a platform that optionally permits movement in one, two or even three dimensions. The abrasive material is dispersed between the specimen and the moveable thinning member having a discontinuous surface such that the abrasive material remains in contact with the discontinuous surface and the surface of the specimen during the thinning process. The instrument means serves to move the moveable thinning member with the discontinuous surface in one, two or three dimensions. In one embodiment, the moveable thinning member has a cylindrical geometry (a wheel) and the instrument means rotates the wheel such that the wheel discontinuous surface and abrasive are in contact with the specimen surface, thereby thinning the specimen surface. In another embodiment, the moveable thinning member has a planar discontinuous surface and the thinning member is moved in one or two dimensions across the surface of the specimen. The thinning member generally but optionally has a means, such as a spindle, axle, or other similar means, for connecting the thinning member to the means for moving the thinning member relative to the specimen surface.

There are instrument means commercially available for moving the discontinuous surface relative to the surface of the material to be thinned (that is, the specimen) that typically are capable of applying a force of 0 to upwards of 60 grams to a surface with wheel rotation rates of 0 to 100 RPM or lateral movement of various speeds. When a wheel is used, specimen rotation rates of 0 to 20 RPM are typically used. The composition of specimens to be thinned is varied but typically include metals, such as Ni, W, Ti, Mo, Fe, Cu, Al, and their alloys such as steel, ceramics, glasses and semiconductor materials, such as alumina, sapphire, TiN, Si, InP, InAs, SiC, GaN, and geological and mineralogical specimens. The abrasive material typically used include diamond, alumina, boron-carbide, cubic boron-nitride, and silicon-carbide with abrasive sized ranging from less than approximately 0.05 $\mu$m to over 30 $\mu$m. Abrasive carrier solutions of water-soluble oil, oil, glycerine, and water are typically used.

Figure 2:
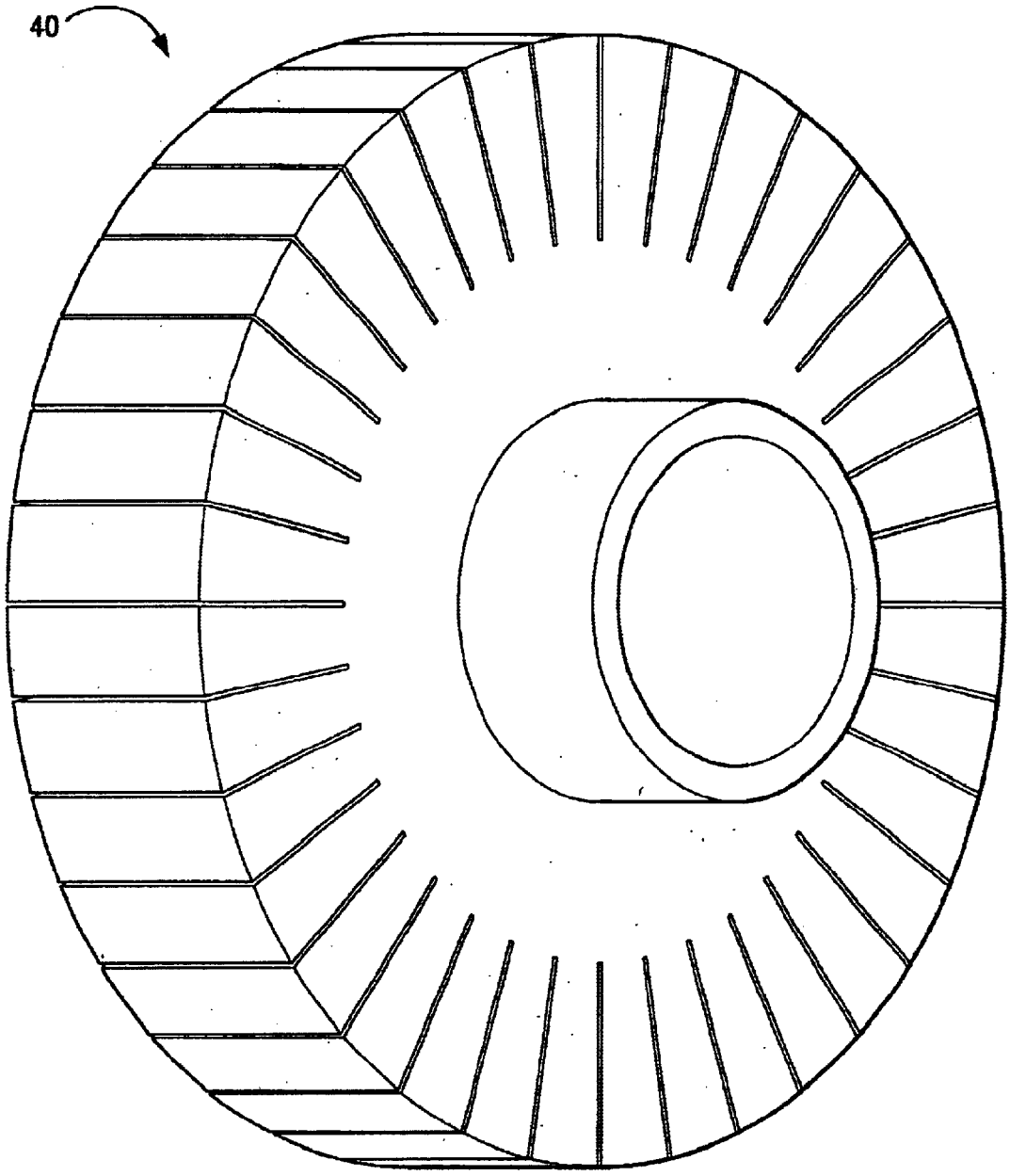
FIG. 2 shows an illustration of a slotted wheel.

One embodiment of the present invention utilizes an instrument means to rotate a hard metal wheel, in this case a commercial dimpling instrument. The hard metal wheel was a stainless steel wheel, 15 mm in diameter with a width of 1 mm, modified by cutting slots (250 $\mu$m wide and approximately 1 mm deep) across the outer surface of the wheel and perpendicular to the edge, with the slots placed at approximately 10° intervals around the circumference. An illustration of a wheel 40 with this modification is seen in FIG. 2. The modified wheel was examined and any burrs resulting from the cutting were removed; this wheel with its discontinuous surface was then used in conjunction with a standard commercial apparatus used to rotate the discontinuous surface and an abrasive material to produce a deep dimple in Si to smooth any other irregularities produced by the cutting. This last step is optional when using improved manufacturing methods to produce these patterned wheels.

The material removal rate was measured with this wheel versus that of an unpatterned (unmodified), smooth wheel of the same material. In one test of the discontinuous, slotted wheel surface, sapphire wafer pieces were dimpled with polishing paste with 3 $\mu$m diamond grit used as the abrasive material. The dimpling was monitored to assure that sufficient diamond polish was present at all times. All other dimpling parameters were held constant between the two tests. The volume of material removed was found to increase approximately linearly with dimpling time for both wheels; however, the removal rate of the slotted wheel was twice that of the smooth wheel. A third wheel was also evaluated under the same conditions, a stainless steel wheel with slots at 45 degrees to the edge. It gave a removal rate essentially equal to that of the wheel with perpendicular slots, again twice the rate of the smooth, unpatterned wheel. Tests were performed using silicon, silicon carbide and sapphire as the material to be thinned. For all of these materials, the present invention provided increased performance relative to unmodified rotating surfaces.

In another embodiment, a dimpling instrument from a different commercial manufacturer and bronze wheels (15 mm diameter, 2 mm thick) were used to polish sapphire with 6 $\mu$m diamond grit. In this embodiment, the bronze wheels were modified by forming slotted patterns to form a discontinuous surface on the wheel. The removal rate of slotted wheels was almost three times that of smooth, continuous-surface wheels. Four types of slotted patterns were cut into wheels, such as the wheel 40 depicted in FIG. 2, for evaluation in this test: a) 90° slots (perpendicular to the wheel edge) spaced every 10° around the circumference, b) the same 90° slots spaced every 10°, but with the trailing side of the slot (with respect to rotation direction) beveled at 45°, c) 90° slots spaced every 5°, and-d) double-slotted wheel with slots at +45° and −45°, both spaced every 10°. Results with all four slotted wheels give approximately the rapid removal rate.

In another third embodiment, a dimpling instrument was used with bronze wheels to dimple sapphire with a finer, 1 μm diamond grit. With the other parameters held the same as in the second test (above), the removal rates were lower for this finer grit. However, a wheel with 90° slots placed every 10° gave a removal rate approximately 1.5 times that of the unmodified, smooth bronze wheel. In addition, a bronze wheel was modified by sanding its surface with 120 grit sandpaper to produce a surface covered with fine grooves that were essentially oriented perpendicular to the wheel edge. This wheel also gave a faster rate similar to that of the slotted wheel.

Tests have shown that hard materials, such as sapphire, can be dimpled more rapidly with patterned wheels. Speed is of direct importance because sapphire is hard and thins slowly. Operating at conditions (wheel load, size of diamond grit) known not to fracture this brittle material, the dimpling process is accomplished more quickly. Thinning using the present invention can now occur at twice the rate or more as with the unmodified wheels of current technology, which is important for some sapphire specimens that would require more than an hour to thin (where longer thinning times can be expected to increase the probability of fracturing). Furthermore, the modified wheels are suitable for routine thinning of a wide range of materials, additionally including Ni, Si, compound semiconductors, and glass, all at faster rates. In addition, the polishing grit is more readily retained on the patterned wheels and in the contact zone, allowing the process to proceed without continuous operator oversight. In contrast, achieving maximum dimpling efficiency with smooth wheels requires the operator's continuous attention to ensure and provide polishing grit to the thinning interface.

In another embodiment, a dimpling instrument and bronze wheels were used with 3 μm diamond grit to dimple sapphire. In this case, all the textured wheels produced a faster removal rate than a smooth, unpatterned wheel. However, a wheel with twice as many perpendicular slots (72) gave a faster removal rate than the slotted wheels discussed above (36 slots). These results support the general finding that a rotating, discontinuous surface enhances the removal rate, and also indicate that the specific design of the pattern of the discontinuities can be optimized for removal of material from different types of specimens.

In additional testing, bronze wheels were evaluated that were neither sanded nor slotted, but had a series of small, shallow holes (0.7 mm diameter, 0.5 mm depth) drilled into the surface of the wheel edge at close spacing (approximately every 10 degrees) around the circumference. This surface also produced a faster removal rate than the smooth wheels. All embodiments considered wheel surfaces with several arrangements of slots, sanded wheels, and the wheels with shallow holes, all of which yield a faster dimple rate than unmodified, smooth wheels. It therefore appears that such patterning and texturing generally enhance the dimpling rate of the wheels independently of the exact nature of the patterning.

Non-metallic surface materials were also evaluated. In another embodiment, a plastic rotatable surface, in the geometry of a wheel, was evaluated. These plastic wheels are found to be almost totally ineffective for dimpling in their unmodified condition with smooth contacting surfaces. However, plastic wheels that were textured by sanding or with shallow holes produce an increased dimpling rate.

The present invention takes advantage of the properties inherent in materials, such as polymeric materials, to allow the formulation of a much simplified dimpling protocol. Applying the present invention to a wheel constructed of DELRIN™ it is practical to dimple, in one embodiment, a variety of materials from start to completion using only this wheel and a slurry consisting of 1 um diamond compound and METADI™ paste extender. Using this protocol, even very hard, brittle materials such as SiC and sapphire can be dimpled from initial thicknesses of 90–100 um to final thicknesses of 6–8 um in three to four hours. This simplified dimpling protocol can be effective when applied to the preparation of other materials; such as Si and compound semiconductors, using the patterned surfaces of the present invention.

The patterned surface produced from various materials, including plastics, modified with fine grooves on its contact surface, is hard and tough enough to grind hard materials such as sapphire and silicon-carbide with reasonable efficiency; typically 3–4 hours per specimen. At the same time it is flexible enough to prevent fracturing brittle materials under the stress of grinding/polishing to thicknesses of less than 20 um. A softer, plastic dimpling wheel can absorb stresses that could otherwise fracture the thinner specimen. Also, a shortened thinning time can lessen the chance for fracturing. Delicate, softer semiconductor specimens, such as InP, can be thinned to a reduced thickness (approximately 5 microns) with a discontinuous plastic wheel more efficiently than with continuous-surface metal wheels.

Therefore, these extensive tests have demonstrated that both metallic and non-metallic surfaces, when modified according to the present invention, provide advantages in material removal from desired specimen materials.

Tests demonstrate that the modification (patterning) to produce a discontinuous contacting surface adds improved functionality by carrying abrasive grit around the wheel to the contact area between the specimen and the wheel during rotation. This is supported by an additional observation: during dimpling with smooth wheels, the grit at the contacting surface of the wheel generally decreases in amount as the thinning process progresses, as determined by visual inspection. The contacting area of the rotating wheel surface appears to contain almost no grit, whereas grit is carried in the slots and depressions placed in the wheel by patterning. The essential role of the grit is confirmed by tests using both slotted and smooth stainless steel wheels operating with only the cutting fluid used to thin the paste/grit in the other tests (no abrasive grit used in this test): Here, the removal rate is more than 30 times slower, with the smooth wheel performing better than the slotted wheel. Thus the patterning is only effective when abrasive is present, supporting the hypothesis that the pattern carries grit to the dimple center more effectively.

In all of the described embodiments, the presence of patterning appears more important than the details of the pattern. Moreover, tests were done with dimpling instruments and wheels supplied by two different vendors; the tests indicate that the wheels modified according to the present invention perform much better.

Figure 3:
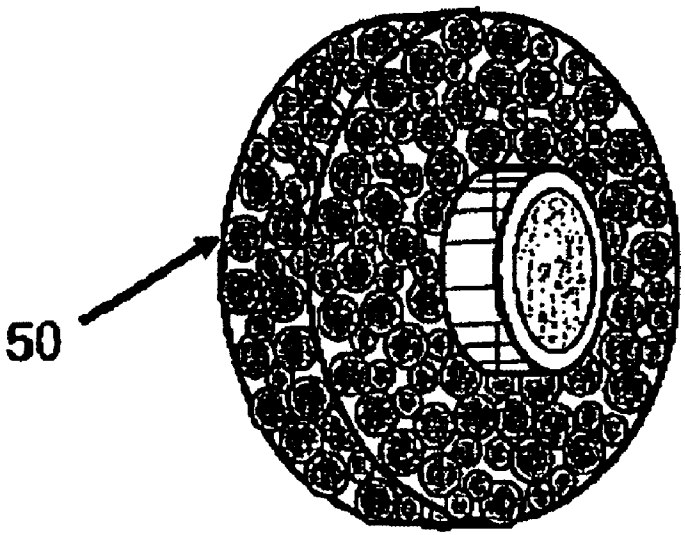
FIG. 3 shows an illustration of a wheel made of sintered bronze particles.

In another embodiment, the present invention utilized a dimpling instrument with a new type of wheel made of a porous bronze material produced by sintering bronze particles together into a solid with high porosity. This wheel 50 is illustrated in FIG. 3. In this embodiment, the discontinuous surface of the rotating surface is not formed by modifying an existing smooth surface but formed by materials and a process that inherently forms a discontinuous surface. The texture consists of smooth oval-like areas (400–500 μm across) of bronze with pores (200–300 μm across) between them.

These porous bronze wheels were tested to determine the thinning rate. In dimpling the hard material sapphire, with the wheel fitted to one manufacturer's dimpling instrument, the porous bronze wheel removed material 1.5 times faster than the slotted-texture, stainless-steel, dimple wheels, and more than 5 times faster than the unmodified manufacturer's wheel with its smooth surface. In tests on sapphire with a second manufacturer's dimpling instrument, the sintered porous bronze wheel removed material 1.3 times faster than the slotted-texture wheels of the present invention and almost 4 times faster than the smooth manufacturer's wheel. Together, these two tests indicate that this type of discontinuous surface further improves the dimpling rate of very hard materials like sapphire, and is several (4–5) times faster than the non-modified wheels, independently of which dimpling instrument is used. In addition, the pores in the porous wheel were found to be readily filled with the slurry made of cutting fluid and diamond grit and to retain the slurry for tens of minutes during dimpling. Dimpling can then proceed with minimal operator attention, whereas the smooth wheels requires frequent attention to keep the slurry in position so that some will be carried to the contact site to polish the specimen.

The present invention also allows greater control that results from the increased thinning rate. For instance, in the final stages of thinning cross-section specimens of GaN grown on sapphire a softer wheel material is desirable at thicknesses below 30 μm to help eliminate fracturing the thin, brittle material at the center of the dimple. Si is often glued to the GaN; forming one half of these specimens, because it thins evenly and its light-transmission properties can be used to monitor the thickness of the specimen during dimpling. Felt wheels can be used with fine diamond or alumina grit to achieve the desired scratch free dimple surface prior to ion-milling, but a more rigid material is desirable in order to avoid the characteristic differential thinning resulting from the use of felt or similarly napped fabrics, when dimpling multi-material or composite specimens. This occurs as a result of the flexible felt fibers compressing against the hard sapphire but rebounding and polishing the softer Si supporting material on either side of the sapphire to greater depth. If the Si is thinned more than the sapphire, it can be eroded prematurely in the ion mill, with the result that the optimum thin area is not located at the GaN surface of the sapphire as desired. Plastic has a hardness and rigidity intermediate between the metals and felt. However, a smooth plastic wheel is not usable for thinning the sapphire since it produces no thinning within practical times. Nonetheless, when the surface of a plastic surface, such as a wheel, is patterned with a either shallow holes, or slots and fine grooving produced by sanding its material removal rate increases significantly and this less rigid surface, with its discontinuous surface, is effective for polishing and final thinning. The sapphire and Si appear to be thinned to the same thickness, that is, no differential thinning allowing the final position of the thinnest material to be selected by ion milling.

In another embodiment utilizing a planar discontinuous surface, a wafer comprising a semiconductor material can be thinned. In preparing polished wafers, a silicon single crystal solid is sliced into disc-shaped wafers and the wafer is placed on a lapping machine where both surfaces are lapped with loose abrasive particles. After immersion in an etchant to remove damaged layers, at least one side is subjected to a chemical mechanical polishing by bringing one of the wafer surfaces into abutment with a moving polishing pad while supplying a polishing liquid containing fine polishing particles, thereby thinning the wafer. The efficiency of this polishing pad can be increased utilizing the present invention by using a polishing pad with a discontinuous surface.

The present invention for thinning, polishing or abrading a contacting material with an abrasive grit or paste is expected to be broadly applicable. Any scheme of polishing, abrading, or cutting through a material with the edge of a rotating wheel can be improved by modification of the rotatable surface, such as by patterning a rotatable wheel. The invention thus applies to other thinning, polishing or abrading processes, even though they may be on much different size scales, either larger or smaller, use very different loading pressures on the wheel, involve very different materials that are used for the wheel or that are being processed by the rotating wheel, and require very different pattern geometries and pattern depths for very different applications.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A method for thinning a surface of a specimen, comprising:

mounting a specimen with an exposed surface on a platform, moving a thinning member article having a discontinuous surface relative said exposed surface using an instrument means, said thinning member article has a discontinuous surface with greater than 10 discontinuities representing greater than approximately 5% of the area of the surface of the thinning member article, said discontinuities selected from the group consisting of grooves, slots, voids, depressions and holes; and dispersing an abrasive material to achieve contact of the abrasive material with the discontinuous surface and the exposed surface, thereby thinning the exposed surface of the specimen.

2. The method of claim 1 wherein said thinning member article comprises a material selected from stainless steel, bronze, brass, copper, a ceramic material, fiberglass, a phenolic composite material, wood, a fiber material, a polymeric material, and a plastic material.

3. The method of claim 1 wherein said thinning member article has a surface with patterned discontinuities.

4. The method of claim 1 wherein said thinning member article has a surface with random discontinuities.

5. The method of claim 1 wherein said thinning member article has a geometry selected from a cylinder, a sphere, and a polyhedra.

6. The method of claim 5 wherein said thinning member article is a wheel.

7. The method of claim 1 wherein said abrasive material comprises a material selected from diamond, alumina, boron-carbide, cubic boron-nitride, and silicon-carbide.

8. The method of claim 7 wherein said abrasive material comprises particles less than approximately 30 microns in diameter.

9. The method of claim 1 wherein said thinning member article has a surface with grooves spaced at approximately 10° intervals around said surface.

10. The method of claim 9 wherein said thinning member article has a surface with grooves cut at an orientation selected from perpendicular to the surface and beveled with respect to the surface.

11. The method of claim 1 wherein the specimen is rotated.

12. The method of claim 1 wherein said thinning member article has a surface modified by sanding the surface.

13. The method of claim 1 wherein said thinning member article comprises a porous bronze material produced by sintering bronze particles together into a solid with high porosity.

14. The method of claim 1 wherein said thinning member article is a wheel rotated at less than approximately 100 revolutions per minute.

15. The method of claim 1 wherein said instrument means applies a force of less than approximately 60 grams to the exposed surface.

* * * * *